US007669445B2

(12) United States Patent
Gartner

(10) Patent No.: US 7,669,445 B2
(45) Date of Patent: Mar. 2, 2010

(54) SPINDLE AND METHOD OF ORIENTING A SPINDLE INTO A DIAL

(76) Inventor: Klaus W. Gartner, 809 Paseo Del Mar, Palos Verdes Estates, CA (US) 90274

( * ) Notice: Subject to any disclaimer, the term of this patent is extended or adjusted under 35 U.S.C. 154(b) by 0 days.

(21) Appl. No.: 11/951,722

(22) Filed: Dec. 6, 2007

(65) Prior Publication Data

US 2009/0145185 A1 Jun. 11, 2009

(51) Int. Cl.
*E05B 15/00* (2006.01)

(52) U.S. Cl. ..... 70/329; 70/422; 70/461; 292/336.5; 292/358; 292/DIG. 60

(58) Field of Classification Search ..... 70/329, 70/332, 410, 422, 1.5, 1.7, 181, 333 R, 461; 292/358, 336.5, DIG. 60
See application file for complete search history.

(56) References Cited

U.S. PATENT DOCUMENTS

| | | | | | |
|---|---|---|---|---|---|
| 90,682 | A | * | 6/1869 | Pillard | 70/322 |
| 289,666 | A | * | 12/1883 | Lee | 292/127 |
| 381,893 | A | * | 4/1888 | White | 70/133 |
| 405,057 | A | * | 6/1889 | Taylor | 70/370 |
| 810,861 | A | * | 1/1906 | Hedges | 109/59 R |
| 876,028 | A | * | 1/1908 | Taylor | 70/329 |
| 934,702 | A | * | 9/1909 | Thomas | 292/169.17 |
| 1,308,521 | A | * | 7/1919 | Butter | 70/311 |
| 1,923,679 | A | * | 8/1933 | Rollo et al. | 292/164 |
| 2,138,856 | A | * | 12/1938 | Harp | 70/216 |
| 2,609,679 | A | * | 9/1952 | Bremer et al. | 70/1.5 |
| 2,637,195 | A | * | 5/1953 | Hurtel | 70/153 |
| 2,728,215 | A | * | 12/1955 | Bremer | 70/332 |
| 2,991,644 | A | * | 7/1961 | Edwards et al. | 70/156 |
| 3,339,958 | A | * | 9/1967 | Lint | 292/169.21 |
| 3,597,949 | A | * | 8/1971 | Nigrelli | 70/490 |
| 3,968,667 | A | * | 7/1976 | Gartner et al. | 70/303 A |
| 3,991,596 | A | * | 11/1976 | Gartner | 70/303 A |
| 4,376,380 | A | * | 3/1983 | Burgess | 70/303 A |
| 4,413,493 | A | * | 11/1983 | Meinsen et al. | 70/422 |
| 4,512,167 | A | | 4/1985 | Remenicky | |
| 4,541,259 | A | | 9/1985 | Uyeda | |

(Continued)

FOREIGN PATENT DOCUMENTS

DE 29907745 U1 8/1999

(Continued)

*Primary Examiner*—Lloyd A Gall
(74) *Attorney, Agent, or Firm*—Barbara A. Wrigley; Oppenheimer Wolff & Donnelly, LLP

(57) ABSTRACT

In one aspect of the present invention, a lock assembly comprises a dial, a lock device, and a spindle having a spindle base and an elongate spindle shaft extending from the spindle base. The spindle shaft comprises a plurality of spindle segments having four sides and separated by a plurality of spaced apart grooves. Each of the spindle segments includes a chamfered leading edge. In another aspect of the present invention, a method of mounting a lock assembly on a mounting surface comprises positioning a dial on a first side of the mounting surface, positioning a lock device on a second side of the mounting surface, determining a distance between the first and second sides, providing a spindle including a plurality of spindle segments having four sides and separated by a plurality of spaced apart grooves, and cutting the spindle at a selected one of the spaced apart grooves.

18 Claims, 16 Drawing Sheets

U.S. PATENT DOCUMENTS

| | | | | |
|---|---|---|---|---|
| 4,667,994 | A * | 5/1987 | Foshee | 292/358 |
| 5,685,584 | A * | 11/1997 | Baren et al. | 292/358 |
| 6,840,070 | B1 * | 1/2005 | Huang et al. | 70/134 |
| 7,523,971 | B2 * | 4/2009 | Ebert | 292/358 |
| 2001/0018837 | A1 * | 9/2001 | Imedio Ocana | 70/422 |
| 2002/0104336 | A1 * | 8/2002 | Witchey | 70/14 |
| 2006/0208507 | A1 | 9/2006 | Huang et al. | |

FOREIGN PATENT DOCUMENTS

| | | | |
|---|---|---|---|
| DE | 102006005675 | A1 | 8/2007 |
| FR | 321710 | A | 1/1903 |

* cited by examiner

| DISTANCE (D) LESS THAN | | CUT GROOVE |
|---|---|---|
| 23 MM | 0.9 IN. | G1 |
| 36 MM | 1.4 IN. | G2 |
| 48 MM | 1.9 IN. | G3 |
| 61 MM | 2.4 IN. | G4 |
| 74 MM | 2.9 IN. | G5 |
| 87 MM | 3.4 IN. | G6 |
| 100 MM | 3.9 IN. | G7 |
| 112 MM | 4.4 IN. | G8 |

SPINDLE AND METHOD OF ORIENTING A SPINDLE INTO A DIAL

BACKGROUND OF THE INVENTION

The present invention relates in general to combination locks, and more particularly to spindles for combination locks that may be easily adapted for use under various mounting conditions.

Combination locks of the multiple tumbler wheel type with which the present invention is concerned usually comprise three disk-shaped tumbler wheels having a gating or notch in their periphery and spaced side-by-side on a cylindrical tumbler post projecting inwardly of the lock housing. One of the tumblers, either the forwardmost or rearmost of the three, typically is driven by a drive pin projecting toward the tumbler from a rotatable driving cam which directly engages a stop on the tumbler or a rotary fly washer which in turn engages such a tumbler stop to provide a lost motion driving connection. The remaining tumblers are driven by an adjacent tumbler in the direction of the driving cam through a similar lost motion driving connection. The driving cam has a generally cylindrical periphery interrupted by a gating shaped to receive a fence lever nose therein at one angular position of the driving cam. The gating is structured to permit the fence carried by the fence lever to approach the tumbler wheels and enter the tumbler gatings when they are aligned with the fence. Thereupon, rotation of the driving cam through a limited arc in a selected direction effects withdrawal of the lock bolt to which the fence lever is pivoted, as a result of the fence lever nose being seated in the driving cam gate.

The driving cam is rotated to position the tumblers and retract or project the bolt by keying it on a drive spindle projecting externally of the lock casing. A mechanical dial is fixed to the external end of the spindle. A typical prior art spindle is usually threaded over a substantial portion of its length, and the driving cam is generally designed with an internally threaded bore structured to be threaded onto the spindle. Both the spindle and driving cam are provided with a spline or keyway and are disposed to be in registry with each other when the driving cam gate is oriented in a preselected relation to the dial markings to receive a spline key and lock the driving cam and spindle against relative rotation. This rotation of the mechanical dial directly rotates the driving cam to effect adjustment of the tumblers and movement of the bolt.

It has been the customary practice in the lock manufacturing industry to locate the mating splines in the spindle and driving cam so that the driving cam may be keyed to the spindle at an angular position wherein the driving cam gating is located immediately below the fence lever nose to receive the nose when the zero dial marking, or a dial marking located no more than about ten points to the left or right of zero, is aligned with the fixed index mark for the dial readings. This practice has been adhered to largely because the dialing conventions for combination locks are such that the dial is usually rotated through three full revolutions in one direction to align the first number of the combination with the fixed index mark, then two full revolutions in the opposite direction to align the second number of the combination with the index mark, then one full revolution in the first direction to align the third number of the combination with the index mark, and then returned to zero and rotated through a preselected small arc to drop the fence lever nose into the driving cam gating, thus retracting the bolt. It is only by keying the driving cam to the spindle at such an angular position that the driving cam gate is positioned to receive the fence lever nose at or near the zero dial position. Thus, prior art spindles required that the manufacturer locate the spline in the spindle at the proper angular position to provide the required angular relationship between the driving cam and dial markings so that the driving cam gate may receive the fence lever nose when the dial is positioned near zero.

This type of spindle design would generally present no particular problem for manufacturers as long as the lock device coupled to the spindle was always installed at the same angular position relative to the dial. However, in actual practice, combination locks are installed in a wide variety of angular positions, termed "hands of installation," depending upon the particular mounting application of the lock. For example, a lock device with a bolt projecting from one end thereof may be arranged in a right hand horizontal installation or a left hand horizontal installation, wherein the bolt projects to the right or to the left, respectively (when viewing the lock device from the rear). Right and left hand horizontal installations allow the lock device to be used with right or left hand swinging doors of safes or other secured areas. In other applications, such as for sliding drawers of filing cabinets, desks, and the like, and in some safe applications, it is desirable to arrange the lock device so that the bolt projects vertically up or down.

Each of these different hands of installation requires that either the spindle or the driving cam spline be located at a different angular position in order to preserve the relationship between the driving cam gate and the zero mark on the dial whereby the fence lever nose can drop into the driving cam gate at a dial position wherein a dial marking near the zero mark is aligned with the fixed index mark located vertically above the center axis of the dial. In order to accommodate the various installation conditions, the commercial locksmith must carry in his stock of repair parts spindles or driving cams keyed for each of the different hands of installation. The general practice for some locksmiths has been to stock spindles splined for each of the four principal hands of installation, including right horizontal, left horizontal, vertical up, and vertical down. However, having to stock a wide variety of spindles is not only inconvenient, but it also presents a substantial financial hardship to the locksmith.

In addition, the length of the spindles used in combination locks is not standardized and depends upon, for example, the separation distance between the dial on one side of the mounting surface and the lock on an opposing side of the mounting surface. For example, in some lock assemblies the required length of the spindle may be about two inches, while in other assemblies it may be about four inches. This factor also increases the variety and quantity of replacement parts which a locksmith must stock and carry in order to be adequately prepared for the variety of replacement possibilities which he may encounter. In some situations the locksmith may cut off a portion of the spindle in order to obtain a spindle having a desired length. However, under such circumstances, the portion of the spindle where the cut is made has to be "deburred" such that all sharp, jagged edges or other abnormalities resulting from the cut are eliminated. If this step is not taken, the spindle may, for example, tear or otherwise damage the cam in the lock device.

Therefore, there is a need for a spindle that may be easily adapted for use in conjunction with various separation distances between the dial and lock device as well as at various hands of installation.

BRIEF SUMMARY OF THE INVENTION

The present invention solves the foregoing problems by providing a lock assembly comprising a mechanical dial, a lock device, and a spindle having a spindle base and an elongate spindle shaft extending from the spindle base, the spindle shaft comprising a plurality of spindle segments having four sides and separated by a plurality of spaced apart grooves, wherein each of the spindle segments includes a chamfered leading edge. The mechanical dial includes a first side, a second side, and a coupling bushing having a bushing aperture on the first side of the mechanical dial. The lock device includes a first side, a second side, and a cam exposed through an aperture in the first side of the lock device. The spindle base is insertable into the bushing aperture in the coupling bushing and the spindle shaft is insertable into a cam aperture in the cam in order to operatively couple the mechanical dial to the lock device.

The present invention also provides a method of mounting a lock assembly on a mounting surface comprising positioning a mechanical dial on a first side of the mounting surface, positioning a lock device on a second side of the mounting surface, determining a distance between the first and second sides of the mounting surface, providing a spindle including a plurality of spindle segments having four sides and separated by a plurality of spaced apart grooves, and cutting the spindle at a selected one of the spaced apart grooves based upon the determined distance between the first and second sides of the mounting surface.

Therefore, one object of the present invention is the provision of a novel dial and spindle construction for combination lock assemblies which may be readily conditioned by locksmiths in the field to adapt the unit for use in lock devices having a wide variety of hands of installation.

Another object of the present invention is the provision of a novel spindle for combination lock assemblies wherein the axial length of the spindle may be easily and quickly altered such that persons in the field can readily assemble the spindle with mechanical dials and lock devices mounted at various separation distances.

Another object of the present invention is the provision of a novel spindle for combination lock assemblies that does not require the use of a spline key to couple the spindle to the driving cam.

Other objects, advantages and capabilities of the present invention will become apparent from the following detailed description, taken in conjunction with the accompanying drawings illustrating one embodiment of the invention.

DETAILED DESCRIPTION OF THE INVENTION

Figure 1:
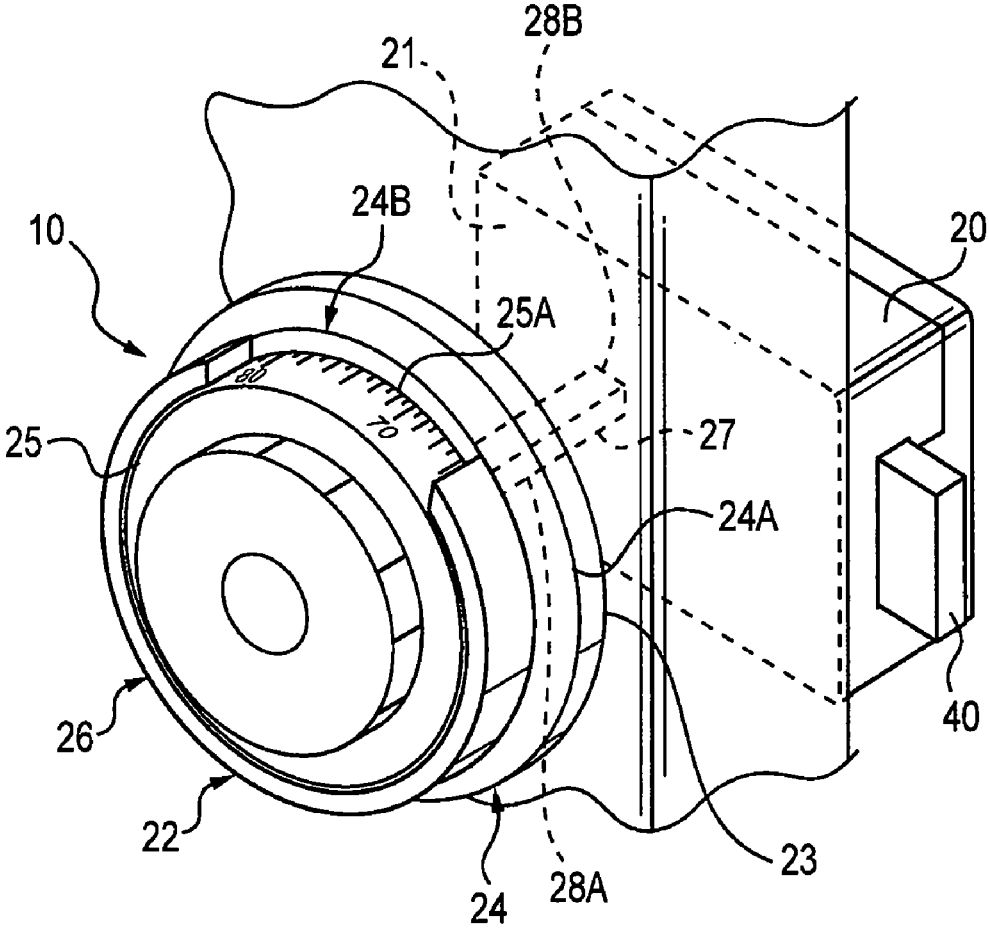
FIG. 1 is a perspective view of an exemplary lock assembly constructed in accordance with the present invention.

FIG. 1 is a perspective view of an exemplary lock assembly 10 in accordance with the present invention. Lock assembly 10 includes lock device 20 having mounting surface 21, mechanical dial 22 having mounting surface 23, dial ring 24 and dial portion 25, and spindle 27 extending between and coupled to lock device 20 and mechanical dial 22. Lock device 20 may be mounted against the inner surface of a door or other closure in a conventional manner, such as by mounting screws extending through screw holes near the corners of the lock housing and into the supporting door. Dial ring 24 includes a cylindrical shield 24A surrounding and shielding from view the major portion of peripheral flange 25A of dial portion 25, the shield 24A being interrupted by a sight opening 24B of suitable circumferential extent.

Dial portion 25 is supported for rotation within the forwardly opening cylindrical well of dial ring 24 defined by shield 24A, and is likewise supported for axial movement inwardly and outwardly with respect to dial ring 24 by means of drive spindle 27 coupled at proximal end 28A to dial portion 25 and at distal end 28B to lock device 20. As illustrated in FIG. 1, dial portion 25 has an integral knob portion 26 thereon which projects forwardly from dial portion 25 to facilitate manipulation of dial portion 25.

Figure 2:
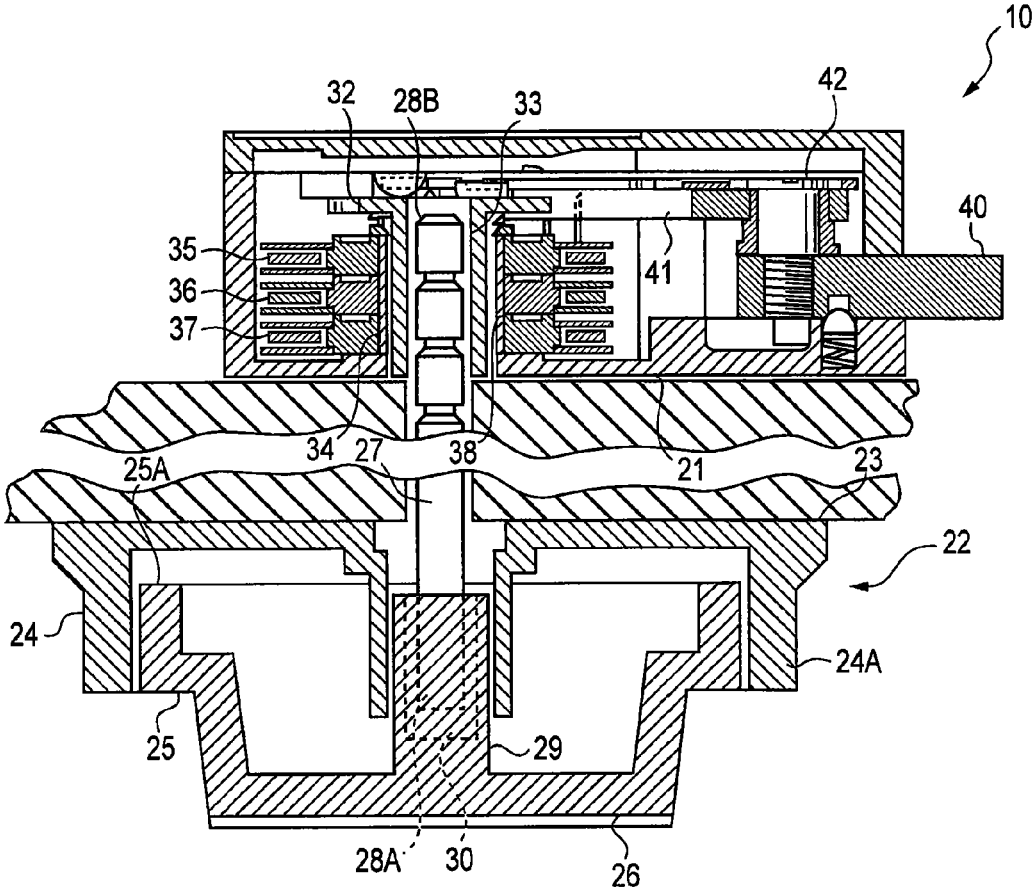
FIG. 2 is a horizontal section view of the lock assembly of FIG. 1.

FIG. 2 is a sectional view of lock assembly 10 illustrating the internal components of lock device 20 and mechanical dial 22. As shown in FIG. 2, dial portion 25 includes coupling bushing 29, while lock device 20 includes driving cam 32. Coupling bushing 29 includes bushing aperture 30 structured to receive proximal end 28A of spindle 27, and cam 32 includes cam aperture 33 structured to receive distal end 28B of spindle 27. Thus, when assembled as shown in FIG. 2, spindle 27 extends between and engages with lock device 20 on one side of a mounting surface and mechanical dial 22 on an opposing side of the mounting surface.

As further illustrated in FIG. 2, a plurality of tumbler wheels, generally indicated by the reference characters 35, 36 and 37, are supported to rotate freely upon a portion of hollow boss 34 projecting rearwardly from mounting surface 21 of lock device 20. Each of tumbler wheels 35, 36 and 37 may be of the conventional type designed to be changed by means of a conventional resetting key to vary the combination of the lock, and to this end may comprise an inner hub on each of which is supported a pair of annular discs having a tumbler gate or peripheral recess therein. The outer annular discs may be selectively locked against rotation relative to their supporting hubs by means of conventional locking arms or levers carried by and between the pairs of annular discs on each hub and engaging peripheral serrations or teeth on the hub to hold the annular discs at a selected angular position. Conventional flys 38, consisting of annular rings having an outwardly extending radial projection thereon, are provided between the forwardmost and the intermediate tumbler wheels 37 and 36, and between the intermediate and rearmost tumbler wheels 36 and 35, to rotate in annular recesses provided in the adjacent faces of the inner hubs of tumblers 37 and 36. The radial projections of the flys are structured to engage stops on the adjacent tumbler wheels in order to provide a lost motion driving connection between the tumbler wheels operatively associated with each fly. The rearmost tumbler wheel 35 is provided with a fly having an annular ring to surround it and ride freely on hollow boss 34 and an outwardly radiating projection adapted to be engaged by a forwardly projecting drive pin on drive cam 32.

Lock device 20 is provided with bolt 40 adapted to slide in a suitable guideway formed in one end wall of the lock device 20. Bolt 40 may be operated by means of fence lever 41 which may be pivotally attached to bolt 40 by means of a screw 42 or other fastener. Fence lever 41 may be provided with a laterally projecting bar, commonly referred to as a fence, which typically projects along an axis parallel to the axis of drive spindle 27 and overlies the peripheries of all of the tumbler wheels 35-37. The fence may be adapted to be received in the peripheral gates of tumbler wheels 35-37 when the tumbler gates are disposed in registry with each other at a chosen angular position upon operation of dial knob 26 to the proper opening combination of the lock. Thereafter, the resulting downward rotation of fence lever 41 will cause bolt 40 to withdraw from its projected or locking position.

Although the above discussion focused on the exemplary lock assembly 10, those skilled in the art will appreciate that spindle 27 may be used in conjunction with various other lock assemblies without departing from the intended scope of the present invention.

Figure 3:
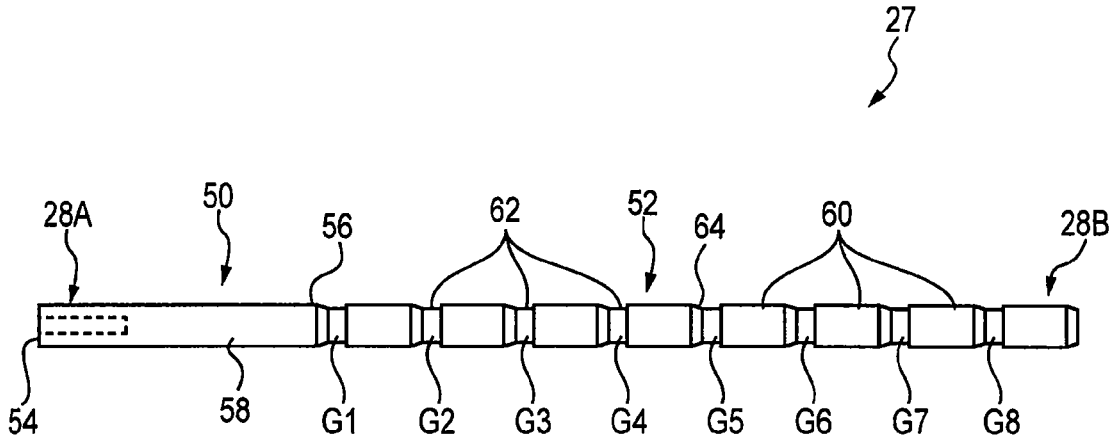
FIG. 3 is a side view of a spindle in accordance with the present invention.

Turning now to FIG. 3, a side view of spindle 27 in accordance with the present invention is shown. Spindle 27 includes spindle base 50 and spindle shaft 52 extending axially from the base. Spindle base 50 includes first end 54, second end 56, and body portion 58. Spindle shaft 52 includes a plurality of spindle segments 60 each separated by a spaced apart groove 62. In addition, each spindle segment 60 includes a chamfered edge 64. As shown in FIG. 3, spindle 27 includes eight spindle segments 60, although one skilled in the art will appreciate that spindles may be designed with a larger or smaller number of spindle segments 60 without departing from the intended scope of the present invention.

In one embodiment, spindle 27 may be formed from a metal. However, those skilled in the art will appreciate that spindle 27 may be formed from any suitable material, including plastics and the like. In addition, spindle 27 may be manufactured with any suitable means such as by casting.

Figure 4:
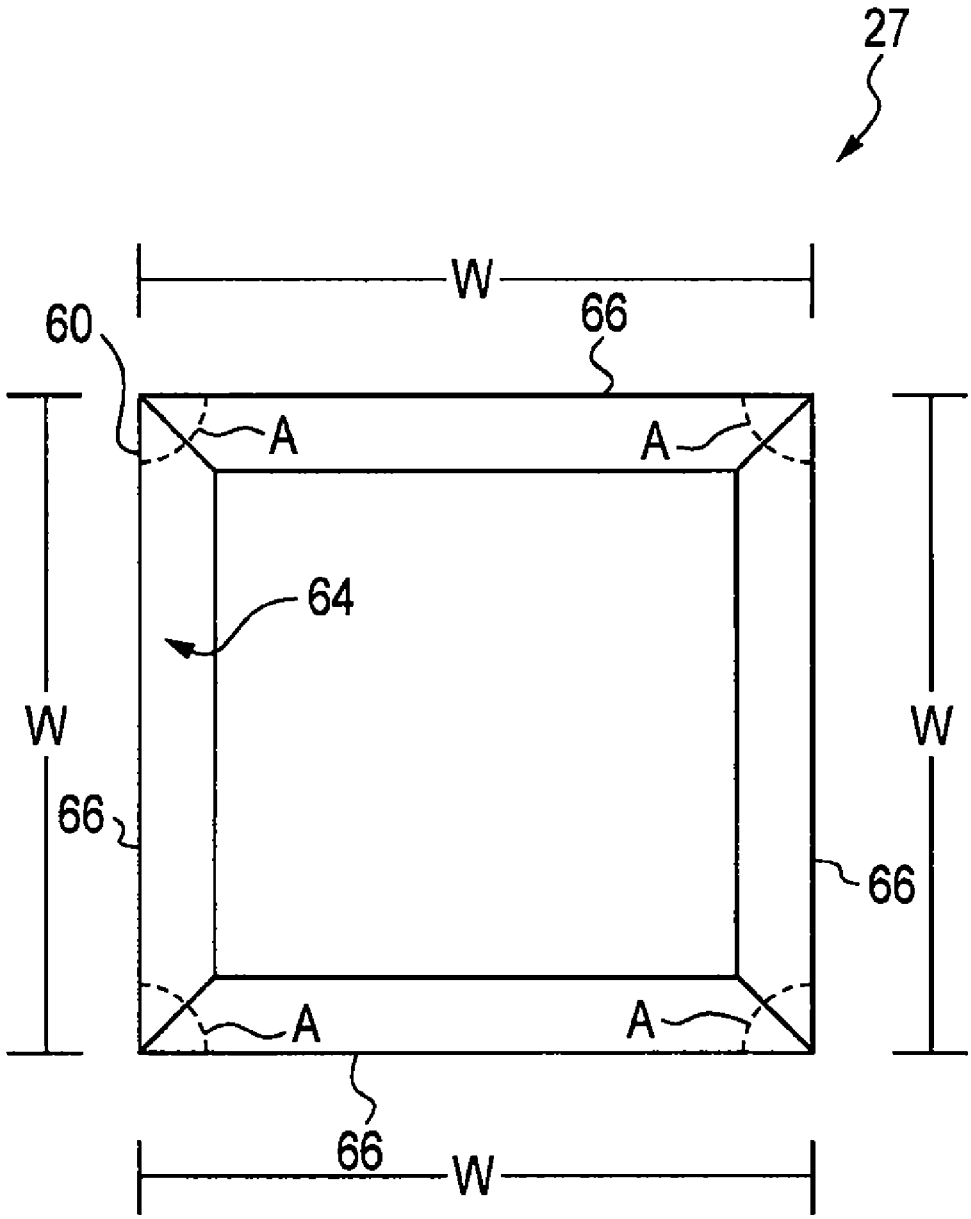
FIG. 4 is a view of a distal end of the spindle of FIG. 3.

FIG. 4 is an end view of spindle shaft 52 of spindle 27. As shown in FIG. 4, each spindle shaft segment 60 includes four substantially flat sides 66. Furthermore, all of the sides 66 of spindle segments 60 have substantially equal widths W, and adjacent sides 66 are substantially perpendicular to one another creating right angles A, thus forming spindle segments that have a generally square-shaped cross-section. However, generally square-shaped spindle segments are shown merely for purposes of example and not limitation. As discussed below, spindle segments 60 having sides 66 with varying widths W and angles A other than about 90 degrees are contemplated and within the intended scope of the present invention. Furthermore, in other embodiments, chamfered edge 64 may be eliminated. Alternatively, chamfered edge 64 may be replaced with another type of edge feature such as, for example, an edge radius, without departing from the intended scope of the present invention. As will be discussed in more detail to follow, a chamfered or other type of edge feature may help assist the locksmith in assembling lock assembly 10 by acting as a guide when spindle shaft 52 is inserted into cam 32. With respect to embodiments of a spindle that do not include a pre-formed chamfer or edge feature, the locksmith may cut or file the edges at a later time.

In one embodiment of spindle 27, the width W of each side 66 of spindle segments 60 is approximately 6 mm. However, spindle segments 60 with sides 66 having numerous other widths W are also contemplated. Furthermore, spindle segments 60 with sides 66 having widths W that are not all substantially equal, and thus form cross-sectional shapes other than a square, are also within the intended scope of the present invention. For example, in other embodiments, spindle segments 60 may include a first pair of opposing sides having a first width and a second pair of opposing sides having a second width, thus forming a spindle segment having a generally rectangular cross-sectional shape. In yet other embodiments, the angle A formed between adjacent sides 66 of spindle segments 60 may be greater or less than 90 degrees, thus forming, for example, a parallelogram. Workers skilled in the art will appreciate that spindle segments 60 may take on numerous other cross-sectional shapes without departing from the intended scope of the present invention.

Up to this point, spindle 27 has been described as including spindle segments 60 with four sides 66. However, other embodiments of a spindle segment in accordance with the present invention may include a number of sides greater or less than four. For example, one alternative spindle design may include spindle segments having three sides and that form a generally triangular cross-sectional shape. In another alternative spindle design, the spindle segments may have five sides that form a generally pentagonal cross-sectional shape.

Figure 5:
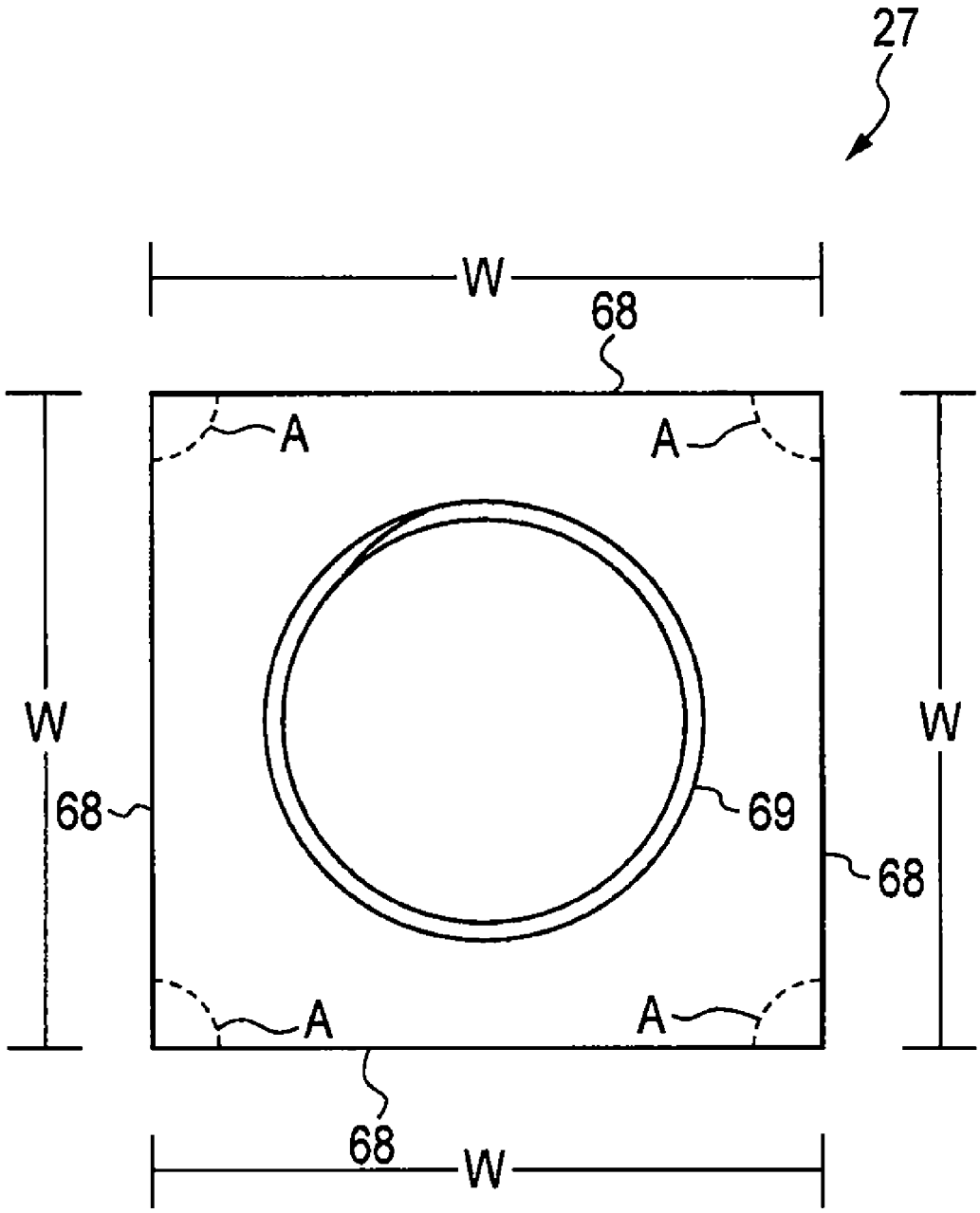
FIG. 5 is a view of a proximal end of the spindle of FIG. 3.

FIG. 5 is an end view of base 50 of spindle 27. As shown in FIG. 5, spindle base 50 includes four substantially flat sides 68 and threaded aperture 69. All of the sides 68 of base 50 have substantially equal widths W, and adjacent sides 68 are substantially perpendicular to one another creating right angles A, thus forming a base having a generally square-shaped cross section. In particular, widths W of sides 68 of base 50 are substantially equal to widths W of sides 66 of spindle segments 60. However, a base 50 having sides 68 with varying widths W and angles A other than about 90 degrees are contemplated and within the intended scope of the present invention.

Threaded aperture 69 in base 50 is structured to receive a fastener such as, for example, a screw or the like. In other embodiments aperture 69 is not threaded, and the fastener is secured within the aperture via other means including, but not limited to, a press-fit type connection or an adhesive.

Figure 6:
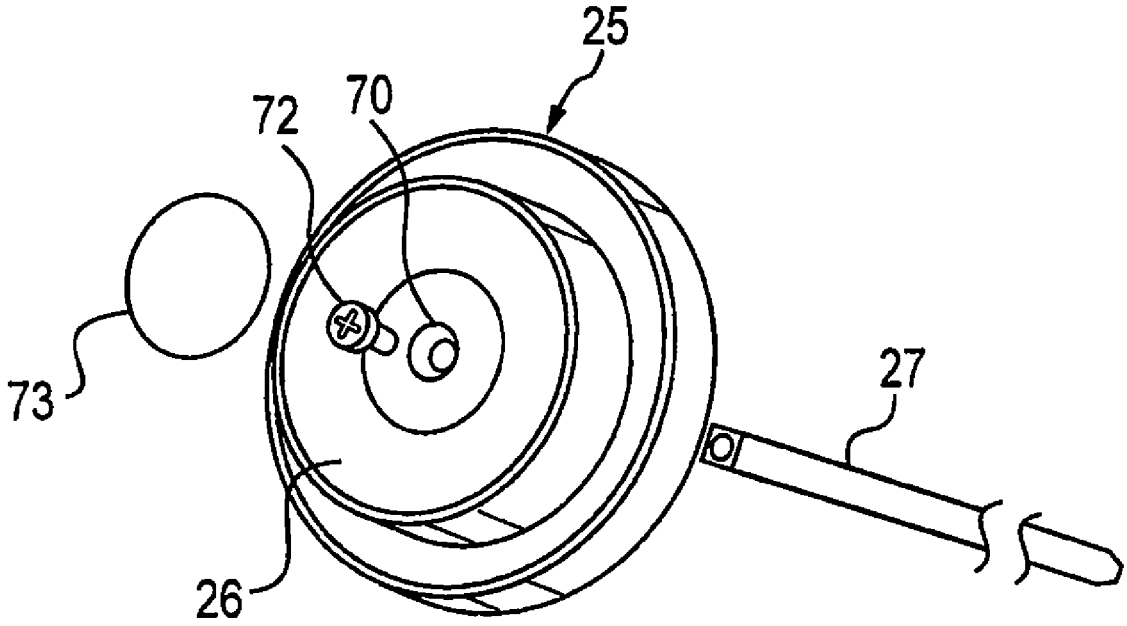
FIG. 6 is an exploded perspective view of a mechanical dial and spindle in accordance with the present invention.
Figure 7:
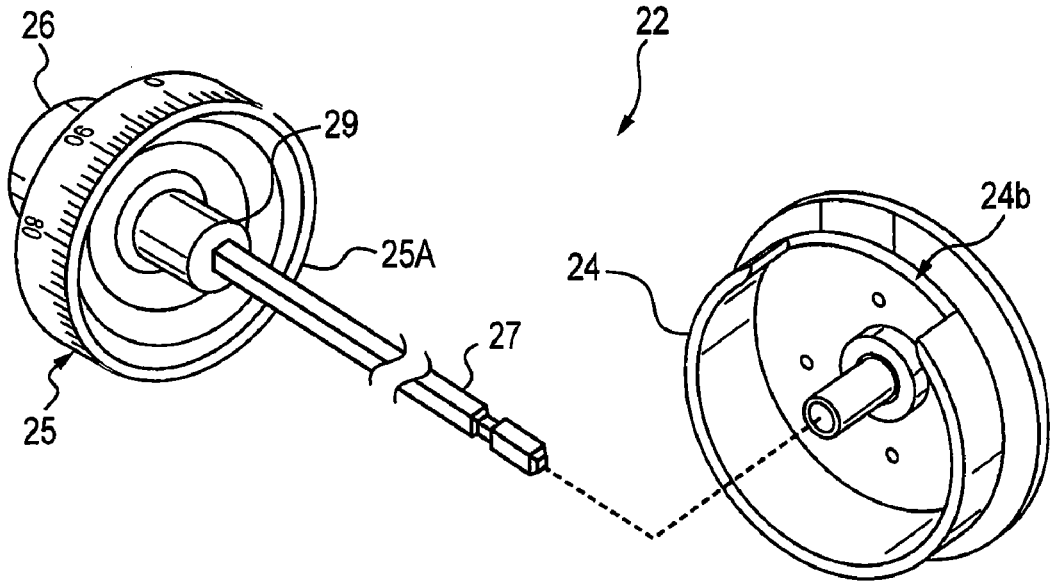
FIG. 7 is a perspective view of the mechanical dial showing the spindle coupled to a coupling bushing on the dial.

FIG. 6 is an exploded perspective view of mechanical dial 25 and spindle 27. As illustrated in FIG. 6, knob 26 of dial portion 25 includes fastener aperture 70 structured to receive fastener 72. In particular, when spindle 27 and mechanical dial 22 are assembled (as shown in FIG. 1) with spindle base 50 inserted into coupling bushing 29, fastener 72 extends through fastener aperture 70 in knob 26 of dial portion 25 and into bushing aperture 30 of coupling bushing 29 where it engages threaded aperture 69 of spindle base 50. Once fastener 72 is threadably engaged with threaded aperture 69, spindle 27 is maintained at fixed axial and radial positions relative to mechanical dial 22 as illustrated in FIG. 7. An optional fastener cover 73 may be applied to knob 26 to hide fastener 72 after the fastener has been inserted through fastener aperture 70. Fastener cover 73 may include, for example, an adhesive backing configured to adhere fastener cover 73 to knob 26.

Figure 8:
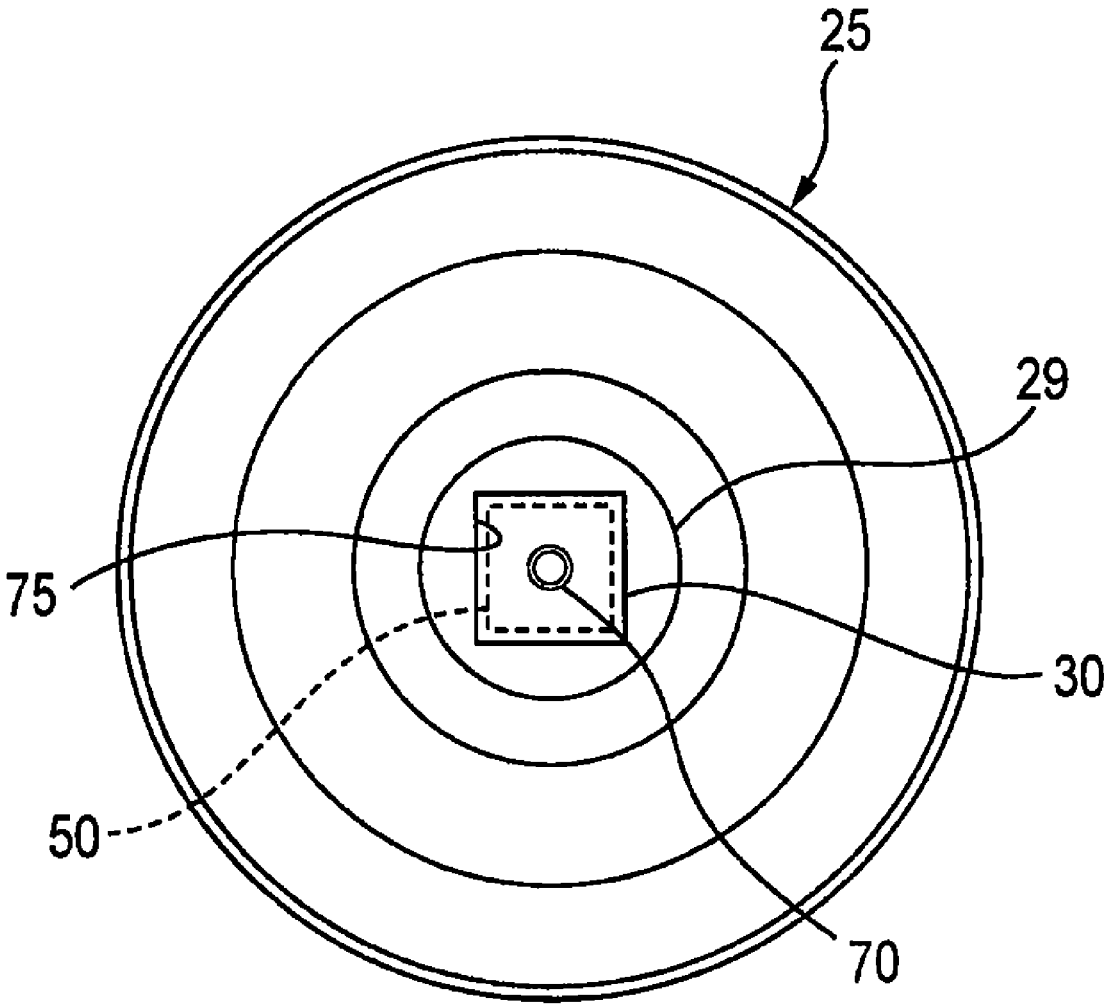
FIG. 8 is a view of the coupling busing illustrating the shape of a bushing aperture.

FIG. 8 is a view of an interior of dial portion 25 illustrating bushing aperture 30 of coupling bushing 29. Bushing aperture 30 includes an aperture surface 75 structured to receive and mate with base 50 of spindle 27. In particular, because spindle base 50 includes four sides 68 having equal widths W, bushing aperture 30 of spindle base 50 is similarly designed with aperture surface 75 forming a generally square-shaped perimeter. Furthermore, because spindle base 50 has a generally square cross-sectional shape, spindle base 50 may be rotated either clockwise or counterclockwise in 90 degree increments from the position illustrated in FIG. 8. Thus, the design of bushing aperture 30 allows base 50 of spindle 27 to be inserted into bushing 29 in any of four alternative angular positions without affecting the operation of spindle 27 with cam 32 and tumbler wheels 35-37.

Figure 9:
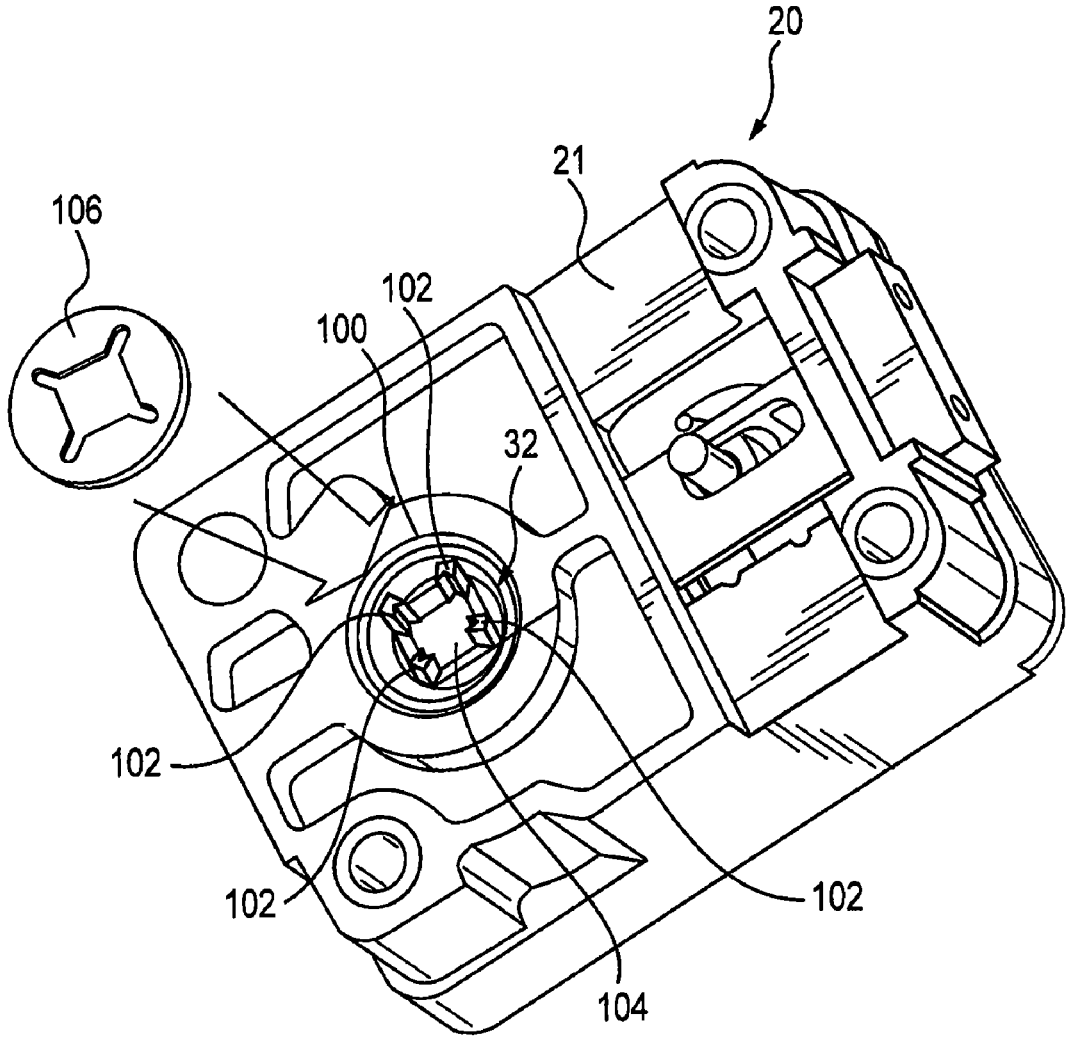
FIG. 9 is a front perspective view of a lock device in accordance with the present invention.

FIG. 9 is a front perspective view of lock device 20 of lock assembly 10. As illustrated in FIG. 9, cam 32 of lock device 20 extends through cam opening 100 in mounting surface 21. Cam 32 includes four posts 102 and a spindle receiving aperture 104 structured to mate with spindle shaft 52 when distal end 28B of spindle 27 is inserted into spindle receiving aperture 104. Furthermore, as illustrated in FIG. 9, cam 32 is structured to receive spring washer 106 such that washer 106 slides over posts 102 of cam 32.

Figure 10:
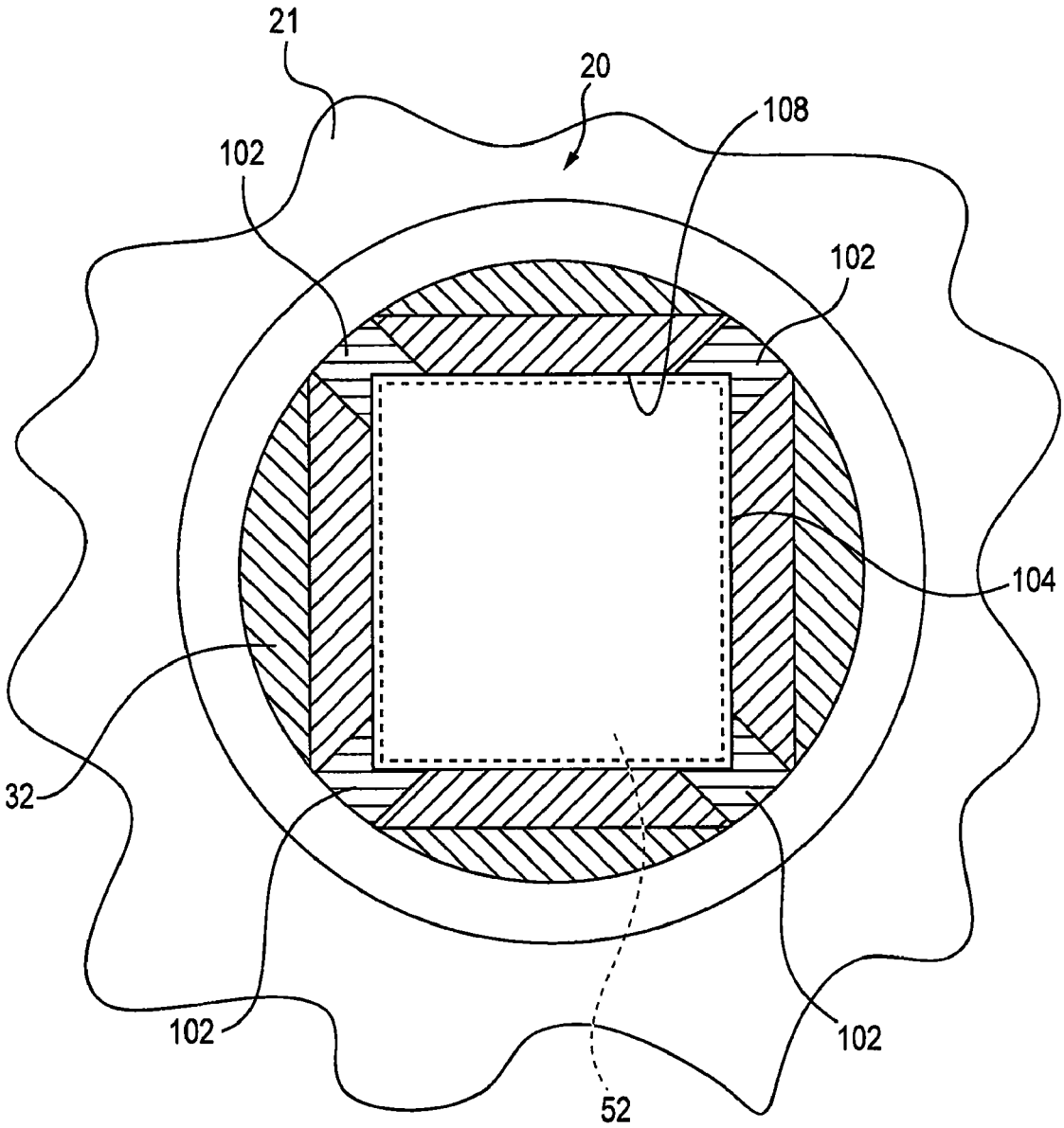
FIG. 10 is an enlarged view of a driving cam of the lock device.

FIG. 10 is an enlarged view of the portion of cam 32 near mounting surface 21 of lock device 20. Cam 32 is illustrated without spring washer 106 merely to illustrate the surface structure of the cam. As illustrated in FIG. 10, cam aperture 104 includes an aperture surface 108 structured to receive and mate with shaft 52 of spindle 27, which is shown in phantom lines. In particular, because spindle shaft 52 includes four sides 66 having equal widths W, cam aperture 104 is similarly designed with aperture surface 108 forming a generally square-shaped perimeter. Similar to the square-shaped design of bushing aperture 30, the square-shaped design of cam aperture 104 allows shaft 52 of spindle 27 to be inserted into cam 32 in any of four alternative angular positions. Furthermore, because spindle shaft 52 is unable to rotate within cam aperture 104, there is no need for a spline in order to "key" spindle shaft 52 to cam 32.

Figure 11:
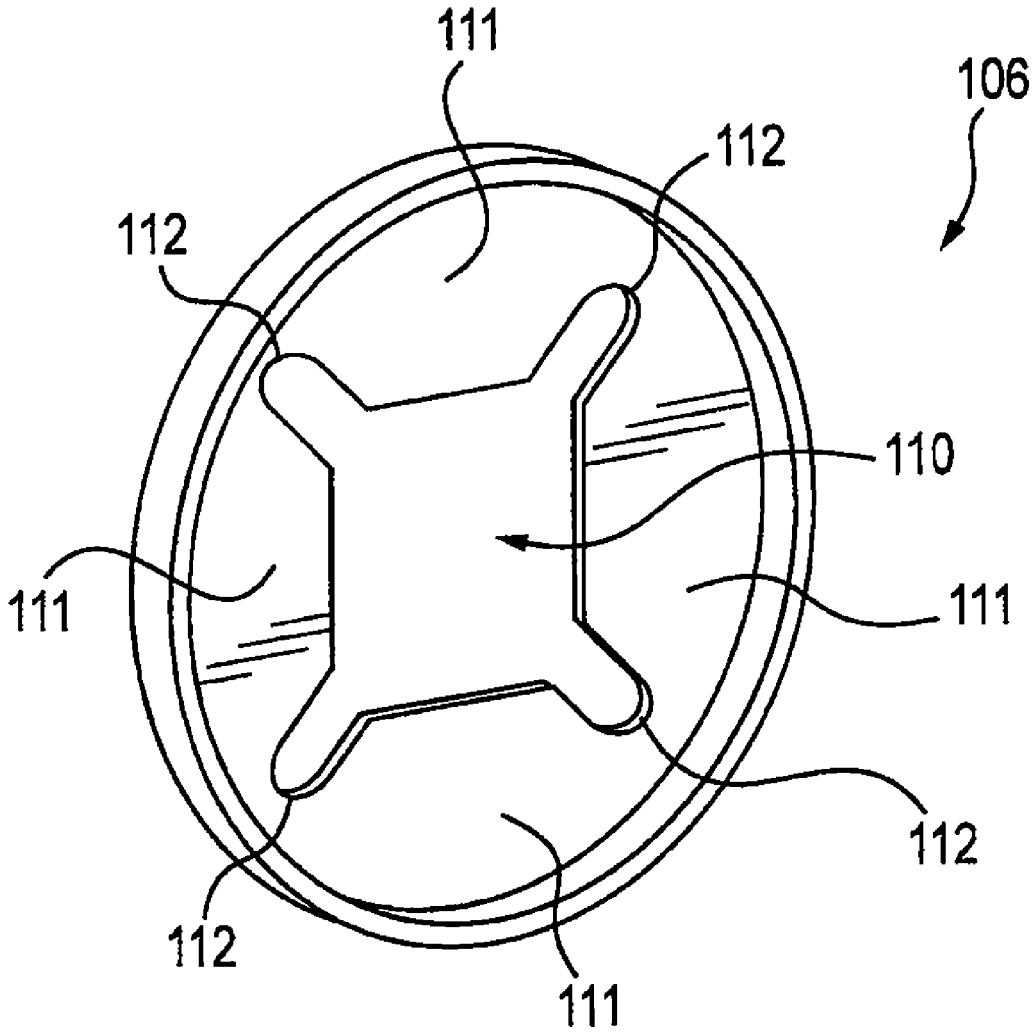
FIG. 11 is a perspective view of a spring washer structured to mate with the driving cam of FIG. 10.

FIG. 11 is a perspective view of spring washer 106, which includes washer aperture 110, four spring members 111, and four notches 112 corresponding to and structured to receive the four posts 102 of cam 32. Spring washer 106 is designed to prevent spindle 27 from being pulled out of cam 32 of lock device 20 once it is installed. Spring washer 106 may be made from numerous materials including, but not limited to, a spring steel. Prior to installation of spindle 27 into cam 32, spring members 111 may be bent in a direction away from mounting surface 21. Then, once shaft 52 of spindle 27 is pushed through washer aperture 110, spring members 111 bend in the opposite direction toward mounting surface 21. As a result, spring members 111 engage spindle shaft 52, thereby preventing spindle 27 from being pulled back out of cam 32 of lock device 20 through spring washer 106.

Figure 12:
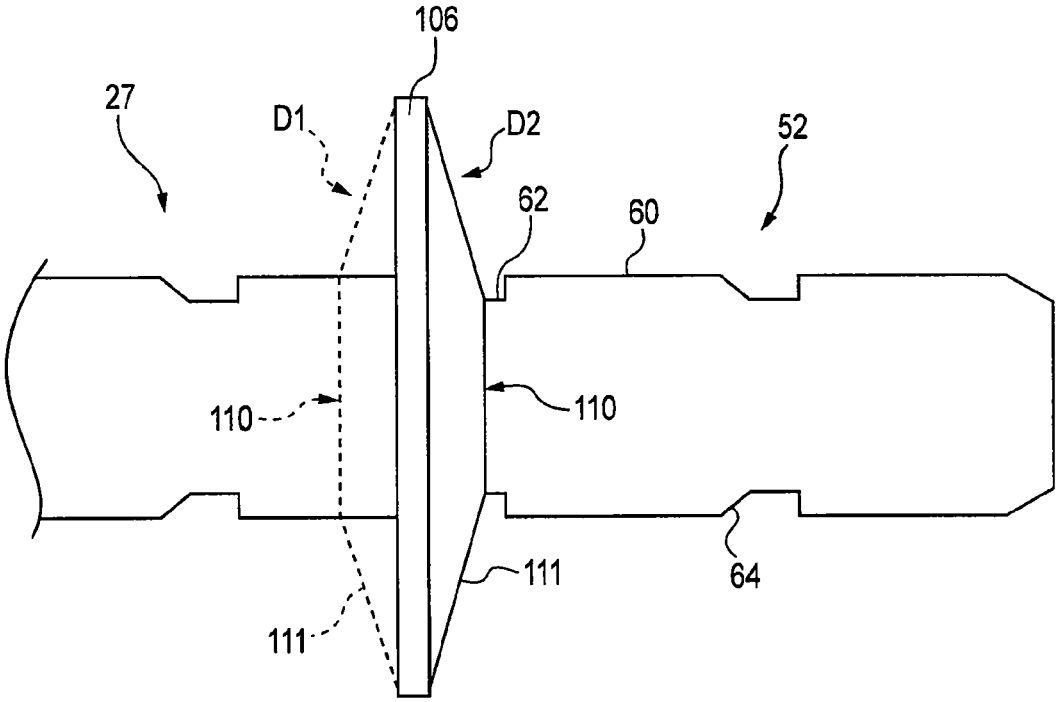
FIG. 12 is a diagram illustrating the operation of the spring washer with a spindle.

FIG. 12 is a diagram illustrating the operation of spring washer 106 and spindle 27. Prior to inserting spindle shaft 52 of spindle 27 into spring washer 106, spring members 111 of spring washer are bent in an outward direction D1 (shown in phantom lines) as described above with reference to FIG. 11. Once spindle shaft 52 of spindle 27 is pushed through washer aperture 110, spring members 111 are designed to bend in an opposite direction D2 as illustrated in FIG. 12. Each of the four spring members 111 are designed to engage with one of grooves 62 between two adjacent spindle segments 60, thereby preventing spindle 27 from being pulled back through washer 106 in a direction opposite of that in which it was previously inserted.

Chamfered edges 64 of spindle segments 60 may serve as a guide for the locksmith and assist the locksmith when trying to align spindle shaft 52 with washer aperture 110. The presence of chamfered edges 64 instead of sharp, un-chamfered edges also reduces the chances of damaging cam 32 when pushing spindle shaft 52 into the cam. Furthermore, chamfered edges 64 may also provide feedback for the locksmith by providing an audible "snap" as they are pushed through washer aperture 110.

Figure 13A:
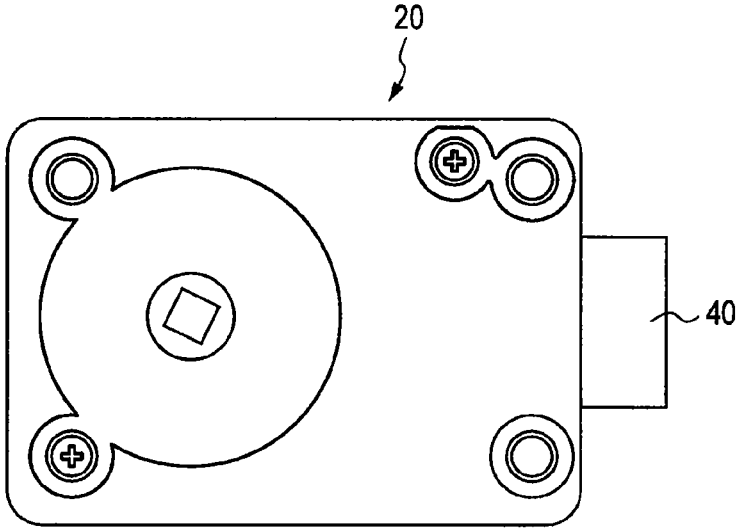
FIGS. 13A-D illustrate four exemplary "hands of installation" in which the lock device of FIG. 9 may be mounted.
Figure 13B:
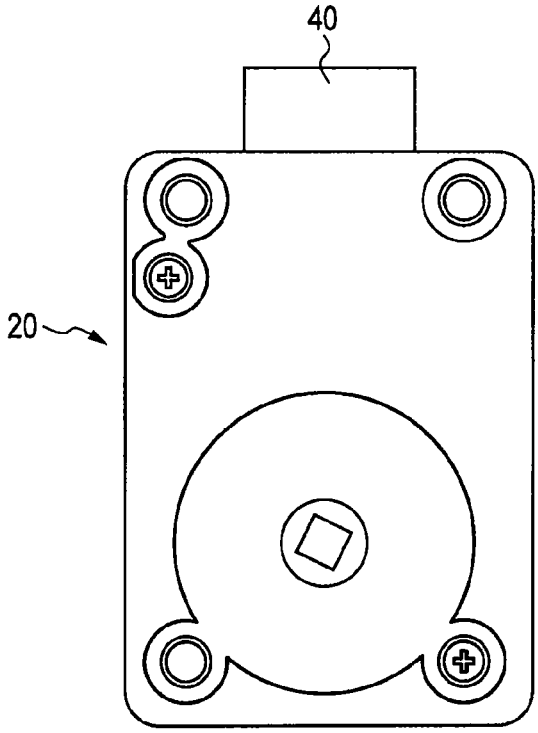
Figure 13C:
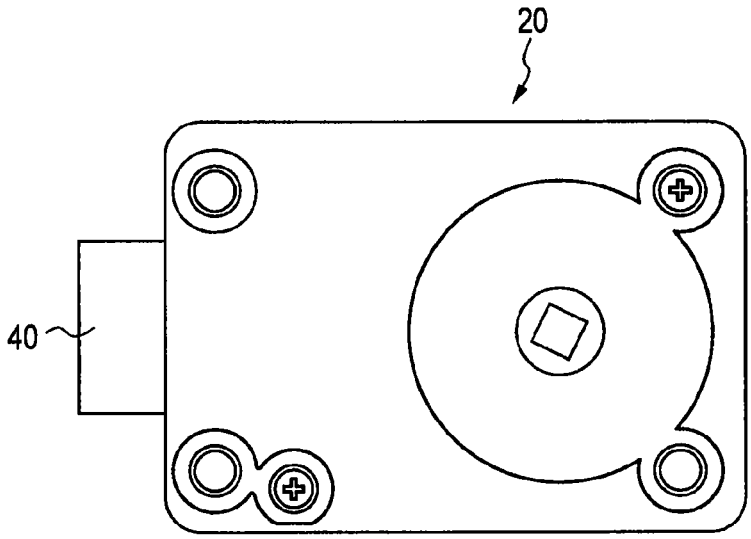
Figure 13D:
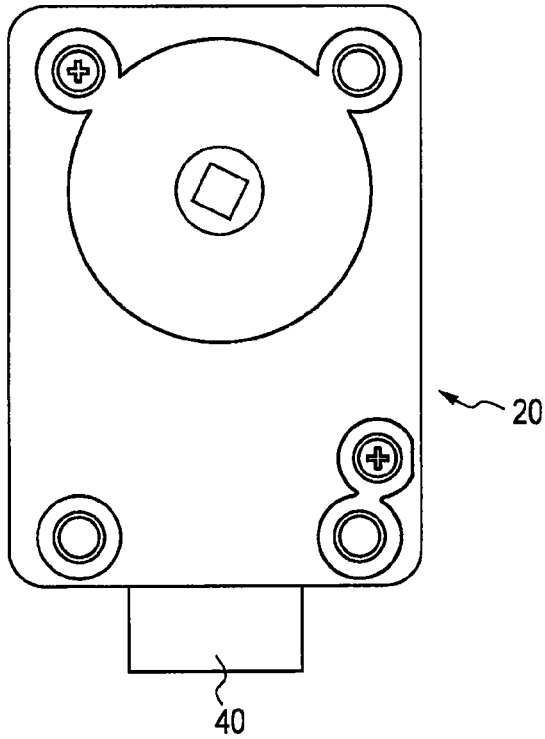

FIGS. 13A-D illustrate four exemplary "hands of installation" in which lock device 20 may be mounted and utilized in conjunction with spindle 27 in accordance with the present invention. In particular, lock device 20 may be mounted on a mounting surface such that bolt 40 is oriented in a right hand horizontal direction as illustrated in FIG. 13A, in an upward direction as illustrated in FIG. 13B, in a left hand horizontal direction as illustrated in FIG. 13C, or in a downward direction as illustrated in FIG. 13D. Lock device 20 may be mounted as shown in any of FIGS. 13A-D without making any adjustments to the angular orientation of spindle 27. In particular, even when lock device 20 is rotated in 90 degree increments as illustrated in FIGS. 13A-D, the generally square cross-sectional shape of spindle segments 60 allows spindle 27 to be properly keyed to cam 32 without the need for adjusting the angular orientation of the spindle. Thus, spindle 27 may be kept at a fixed angular position with respect to dial portion 25 while the square-shaped spindle shaft 52 will remain keyed to cam 32 in the appropriate manner wherein tumbler wheels 35-37 are positioned in a known relationship relative to numerical markings on dial portion 25. This provides a great advantage over prior spindle designs having a circular cross-section and utilizing a spline key because the angular orientation of such spindles must be altered as the hand of installation changes in order to maintain a known relationship between the position of the tumbler wheels and the numerical markings on the dial.

As stated previously, one common issue for a locksmith or other individual mounting a lock assembly is that the required length of spindles varies depending upon numerous factors related to mounting conditions. For example, with respect to lock assembly 10, the separation distance between mechanical dial 22 and lock device 20 may not always be substantially the same. As a result, the axial length of the spindle spanning between the dial and lock may be too long to assemble the lock assembly such that distal end 28B of spindle 27 is contained within the interior of lock device 20. In order to address this problem, spindle 27 of the present invention has an axial length that may be shortened so as to be compatible with mechanical dials and lock devices that are mounted at various separation distances.

Figures 14, 15:
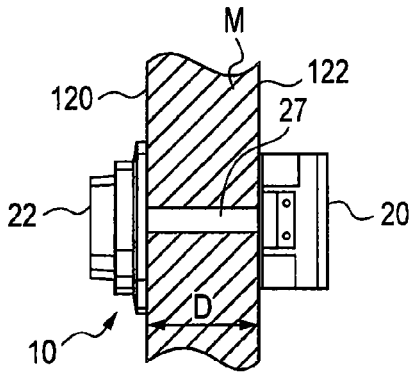
FIG. 14 illustrates a separation distance between a mechanical dial and a lock device coupled to a mounting surface.
FIG. 15 illustrates one example of a spindle size table in accordance with the present invention.

FIG. 14 illustrates mechanical dial 22 and lock device 20 of lock assembly 10 coupled to a mounting surface M. In accordance with one aspect of the present invention, spindle 27 may be cut to various lengths in order to accommodate the separation distance between mechanical dial 22 and lock device 20 when mounted to mounting surface M. First, distance D between first side 120 and second side 122 of mounting surface M may be measured to determine the approximate spacing between mechanical dial 22 and lock device 20. The distance D may then be compared to a spindle size table, such as that illustrated in FIG. 15, in order to determine at which one of grooves G1-G8 (as shown in FIG. 3) to cut spindle 27 such that it is sized according to the separation between mechanical dial 22 and lock device 20. For example, if distance D is greater than 1.9 in. but less then 2.4 in., then the locksmith would cut spindle 27 at groove G4 in order to create a custom-fit spindle taking into account the spacing between mechanical dial 22 on first side 120 of mounting surface M and lock device 20 on second side 122 of mounting surface M.

Figure 16:
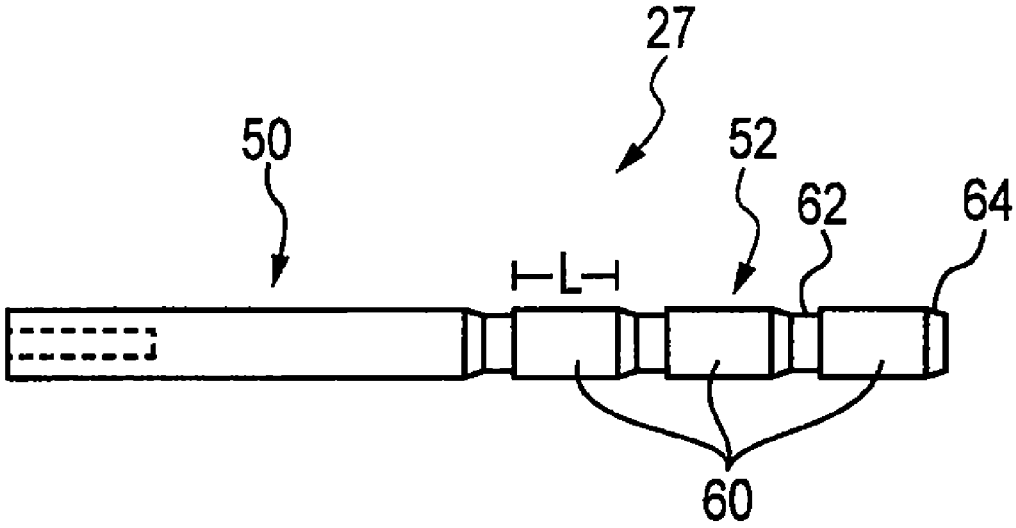
FIG. 16 illustrates one embodiment of a spindle after being cut in accordance with the spindle size table of FIG. 15.

FIG. 16 illustrates spindle 27 after being cut at groove G4 as discussed above. As shown in FIG. 16, groove G4 may be cut such that spindle 27 retains a chamfered leading edge 64. Furthermore, spindle 27 is designed such that once a cut is made in one of grooves 62, no deburring of chamfered edge 64 is generally required. In other words, spindle 27 may be cut such that chamfered edge 64 is "clean" with no sharp edges or other edge defects that would otherwise tear or damage cam 32 once the leading, chamfered edge of spindle 27 is inserted into cam aperture 104.

Once again, although spindle 27 is illustrated with eight spindle segments 60, one skilled in the art will appreciate that spindles having any number of spindle segments are contemplated and within the intended scope of the present invention. Furthermore, the axial length L of each spindle segment 60 may vary in other embodiments such that grooves 62 are spaced closer together or farther apart. Any change in the number of spindle segments or the axial length of each segment would require formulating a new spindle size table (similar to the one shown in FIG. 15) as would be appreciated by one skilled in the art.

Although the present invention has been described with reference to preferred embodiments, workers skilled in the art will recognize that changes may be made in form and detail without departing from the spirit and scope of the invention.

What is claimed is:

1. A spindle for use with a lock assembly consisting essentially of:

an elongate spindle base structured for insertion into a dial; and an elongate spindle shaft extending in an axial direction from a first end of the spindle base and structured for insertion into a lock device, the spindle shaft including:

a plurality of spindle segments each having four sides with a chamfered leading edge and an unchamfered trailing edge, wherein each of the four sides of the spindle segments has a substantially equal first width such that the spindle segments are generally square in cross-section, the chamfered leading edges of the spindle segments being structured to guide the spindle into a cam of the lock device during assembly; and a plurality of spaced apart groove segments each having four sides and separating the plurality of spindle segments, wherein each of the four sides of the groove segments has a substantially equal second width such that the groove segments are generally square in cross-section, the second width being less than the first width such that a cross-sectional area of the groove segments is less than a cross-sectional area of the spindle segments;

wherein the unchamfered trailing edges of the spindle segments are substantially perpendicular to an outer surface of an adjacent one of the groove segments thereby defining a distal shoulder.

2. The spindle of claim 1, further including a fastening means, wherein a second end of the base includes an aperture structured for receiving the fastening means.

3. The spindle of claim 2, wherein the aperture is threaded.

4. The spindle of claim 3, wherein the fastening means is a screw.

5. The spindle of claim 1, wherein the spindle base includes four sides.

6. The spindle of claim 5, wherein the spindle base is generally square in cross-section.

7. A lock assembly consisting of:

a dial having a first side, a second side, and a coupling bushing having a bushing aperture on the first side of the dial;

a lock device having a first side, a second side, and a cam exposed through an aperture in the first side of the lock device; and a spindle having a spindle base insertable into the bushing aperture and an elongate spindle shaft extending from the spindle base, the spindle shaft including:

a plurality of spindle segments each having four sides with a chamfered leading edge and an unchamfered trailing edge, wherein each of the four sides of the spindle segments has a substantially equal first width such that the spindle segments are generally square in cross-section; and a plurality of spaced apart groove segments each having four sides and separating the plurality of spindle segments, wherein each of the four sides of the groove segments has a substantially equal second width such that the groove segments are generally square in cross-section, the second width being less than the first width such that a cross-sectional area of the groove segments is less than a cross-sectional area of the spindle segments;

wherein the unchamfered trailing edges of the spindle segments are substantially perpendicular to an outer surface of an adjacent one of the groove segments thereby defining a distal shoulder;

the spindle shaft being insertable in a first direction through a spring washer coupled to the cam and into a cam aperture, the spring washer having a generally square washer aperture surrounded by four spring members that are each structured to engage a corresponding side of a selected one of the groove segments;

wherein the distal shoulder formed adjacent to the selected one of the groove segments and the spring washer cooperate to prevent removal of the spindle shaft from the cam when the spindle is pulled in a direction opposite the first direction.

8. The lock assembly of claim 7, wherein the spindle shaft includes eight spindle segments.

9. The lock assembly of claim 7, wherein the spindle base is generally square in cross-section.

10. The lock assembly of claim 7, further including a fastener, wherein the spindle base includes a threaded aperture structured to receive the fastener.

11. The lock assembly of claim 10, wherein the fastener is insertable through a fastener aperture in the second side of the dial and into the threaded aperture in the spindle base.

12. The lock assembly of claim 7, wherein the cam includes at least one post extending from the cam around the cam aperture.

13. The lock assembly of claim 12, wherein the spring washer includes at least one notch structured to receive the at least one post on the cam to couple the spring washer to the cam.

14. A method of mounting a lock assembly on a mounting surface comprising:

positioning a dial on a first side of a mounting surface;

positioning a lock device on a second side of the mounting surface, the lock device having a rotatable driving cam;

determining a distance between the first and second sides of the mounting surface;

providing a spindle comprising:

a plurality of spindle segments each having four sides with a chamfered leading edge and an unchamfered trailing edge, wherein each of the four sides of the spindle segments has a substantially equal first width such that the spindle segments are generally square in cross-section; and a plurality of spaced apart groove segments each having four sides and separating the plurality of spindle segments, wherein each of the four sides of the groove segments has a substantially equal second width such that the groove segments are generally square in cross-section, the second width being less than the first width such that a cross-sectional area of the groove segments is less than a cross-sectional area of the spindle segments;

wherein the unchamfered trailing edges of the spindle segments are substantially perpendicular to an outer surface of an adjacent one of the groove segments thereby defining a distal shoulder;

cutting the spindle at a selected one of the groove segments based upon the determined distance between the first and second sides of the mounting surface such that the chamfered leading edges of one of the spindle segments are disposed at a distal end of the spindle; and pushing the distal end of the spindle in a first direction through a spring washer coupled to the driving cam and into an aperture in the driving cam, the spring washer having a generally square washer aperture surrounded by four spring members that are each structured to engage a corresponding side of a selected one of the groove segments;

wherein the distal shoulder formed adjacent to the selected one of the groove segments and the spring washer cooperate to prevent removal of the spindle from the driving cam when the spindle is pulled in a direction opposite the first direction.

15. The method of claim 14, further comprising the step of inserting a proximal end of the spindle into a coupling bushing of the dial.

16. The method of claim 15, wherein the driving cam includes at least one post extending from the driving cam around a cam aperture, and wherein the spring washer includes at least one notch structured to receive the at least one post on the driving cam to couple the spring washer to the driving cam.

17. A method of mounting a lock assembly on a mounting surface consisting essentially of:

positioning a dial on a first side of a mounting surface;

positioning a lock device on a second side of the mounting surface;

determining a distance between the first and second sides of the mounting surface;

providing a spindle including:

a plurality of spindle segments each having four sides with a chamfered leading edge and an unchamfered trailing edge, wherein each of the spindle segments is generally square in cross-section and defines a first cross-sectional areas; and a plurality of spaced apart groove segments each having four sides and separating the plurality of spindle segments, wherein each of the groove segments is generally square in cross-section and defines a second cross-sectional area that is less than the first cross-sectional area of the spindle segments, the groove segments being bounded on a first end by a shoulder defined by the unchamfered trailing edges of one of the spindle segments and on a second end by the chamfered leading edges of another one of the spindle segments;

cutting the spindle at a selected one of the groove segments based upon the determined distance between the first and second sides of the mounting surface such that the chamfered leading edges of one of the spindle segments are disposed at a distal end of the spindle, wherein upon cutting the spindle the chamfered leading edges at the distal end of the spindle are substantially smooth and no deburring of the chamfered leading edges is required; and inserting the distal end of the spindle into the lock device by pushing the spindle in a first direction through a spring washer and into a driving cam, the spring washer including four spring members that are each structured to engage a corresponding side of a selected one of the groove segments;

wherein the shoulder adjacent to the first end of the selected one of the groove segments and the spring washer are structured to prevent removal of the spindle from the driving cam when the spindle is pulled in a direction opposite the first direction.

18. A method of mounting a lock assembly on a mounting surface consisting of:

positioning a dial on a first side of a mounting surface;

positioning a lock device on a second side of the mounting surface, the lock device having a rotatable driving cam;

determining a distance between the first and second sides of the mounting surface;

providing a spindle including:

a plurality of spindle segments each having four sides with a chamfered leading edge and an unchamfered trailing edge, wherein each of the four sides of the spindle segments has a substantially equal first width such that the spindle segments are generally square in cross-section; and a plurality of spaced apart groove segments each having four sides and separating the plurality of spindle segments, wherein each of the four sides of the groove segments has a substantially equal second width such that the groove segments are generally square in cross-section, the second width being less than the first width such that a cross-sectional area of the groove segments is less than a cross-sectional area of the spindle segments;

wherein the unchamfered trailing edges of the spindle segments are substantially perpendicular to an outer surface of an adjacent one of the groove segments thereby defining a distal shoulder;

cutting the spindle at a selected one of the groove segments based upon the determined distance between the first and second sides of the mounting surface such that the chamfered leading edges of one of the spindle segments are disposed at a distal end of the spindle; and pushing the distal end of the spindle in a first direction though a spring washer coupled to the driving cam and into an aperture in the driving cam, the spring washer having a generally square washer aperture surrounded by four spring members that are each structured to engage a corresponding side of a selected one of the groove segments;

wherein the distal shoulder formed adjacent to the selected one of the groove segments and the spring washer cooperate to prevent removal of the spindle from the driving cam when the spindle is pulled in a direction opposite the first direction.

* * * * *